US006383262B1

(12) United States Patent
Marthinsen et al.

(10) Patent No.: US 6,383,262 B1
(45) Date of Patent: May 7, 2002

(54) ENERGY RECOVERY IN A WELLBORE

(75) Inventors: Lars Marthinsen, Baerums Verk; Geirmund Vislie, Sandefjord, both of (NO)

(73) Assignee: Multiphase Power and Processing Technologies, Inc., Wellsville, NY (US)

( * ) Notice: Subject to any disclaimer, the term of this patent is extended or adjusted under 35 U.S.C. 154(b) by 0 days.

(21) Appl. No.: 09/623,032

(22) PCT Filed: Feb. 22, 1999

(86) PCT No.: PCT/IB99/00314

§ 371 Date: Oct. 19, 2000

§ 102(e) Date: Oct. 19, 2000

(87) PCT Pub. No.: WO99/43924

PCT Pub. Date: Sep. 2, 1999

(30) Foreign Application Priority Data

Feb. 24, 1998 (GB) ..... 9803742

(51) Int. Cl.[7] ..... E21B 43/00; B01D 19/00

(52) U.S. Cl. ..... 95/254; 95/261; 96/157; 96/204; 96/216; 166/75.12; 166/105.5; 166/267

(58) Field of Search ..... 95/254, 260, 261; 96/157, 196, 204, 216; 55/401; 60/641.1, 641.5; 166/267, 105.5, 75.12

(56) References Cited

U.S. PATENT DOCUMENTS 5,490,562 A * 2/1996 Arnold ..... 166/267
5,526,684 A * 6/1996 Liu et al. ..... 73/200

FOREIGN PATENT DOCUMENTS

WO WO 9854441 A2 * 12/1998

* cited by examiner

*Primary Examiner*—Robert A. Hopkins
(74) *Attorney, Agent, or Firm*—Andrus, Sceales, Starke & Sawall

(57) ABSTRACT

A process for the recovery of energy from a pressurised well stream containing a gas/liquid mixture, the process comprising: treating the well stream to a pre-separation process to separate it into gaseous and liquid phases, selecting appropriate proportions of said separated gaseous and liquid phases, recombining said selected proportions, and supplying the recombined mixture to the inlet of a rotary separation turbine, wherein said components are separated and energy is recovered from the flow by rotation of the turbine, said proportions of said gaseous and liquid phases being selected to produce an optimum mixture for supply to the rotary separation turbine.

19 Claims, 2 Drawing Sheets

ENERGY RECOVERY IN A WELLBORE

This invention relates to a process and apparatus for the recovery of energy from a gas/liquid mixture, primarily a gas and oil/water mixture from an oil well.

The general concept of recovering energy from a well stream, whether it be a hydrocarbon well, or a geothermal well, is known. For example, U.S. Pat. No. 5,385,446 shows the use of a rotary separation turbine to recover energy, from, and separate the constituents of a gas liquid mixture from a geothermal well. U.S. Pat. No. 5,117,908 shows that it is known to use a rotary turbine to recover energy from the gas/liquid mixture in the well stream of an oil well as a stage prior to the separation of the gas/liquid mixture.

Rotary separation turbines, for example of the kind illustrated in U.S. Pat. No. 5,385,446 incorporate a specifically designed nozzle through which the inlet mixture is directed into the rotary separation turbine. The present invention is based upon the recognition that such rotary separation turbines are designed to operate with optimum efficiency when supplied at a predetermined flow rate, with a mixture having a predetermined gas/liquid ratio.

In accordance with the present invention there is provided a process for the recovery of energy from a pressurised well stream containing a gas/liquid mixture, the process comprising treating the well stream to a pre-separation process to separate it into gaseous and liquid phases, selecting appropriate proportions of said separated gaseous and liquid phases, recombining said selected proportions, and supplying the recombined mixture to the inlet of a rotary separation turbine wherein said components are separated and energy is recovered from the flow by rotation of the turbine, said proportions of said gaseous and liquid phases being selected to produce an optimum mixture for supply to the rotary separation turbine.

The invention further resides in an apparatus for recovering energy from a well stream comprising a pre-separation device for separation of the well stream into gaseous and liquid components, selection means for selecting predetermined proportions of said gaseous and liquid components, mixing means for recombining said selected proportions, and a rotary separation turbine driven by said recombined mixture.

One example of the invention is illustrated in the accompanying drawings wherein FIG. 1 is a diagrammatic representation of a basic energy recovery process and apparatus;

Figure 1:
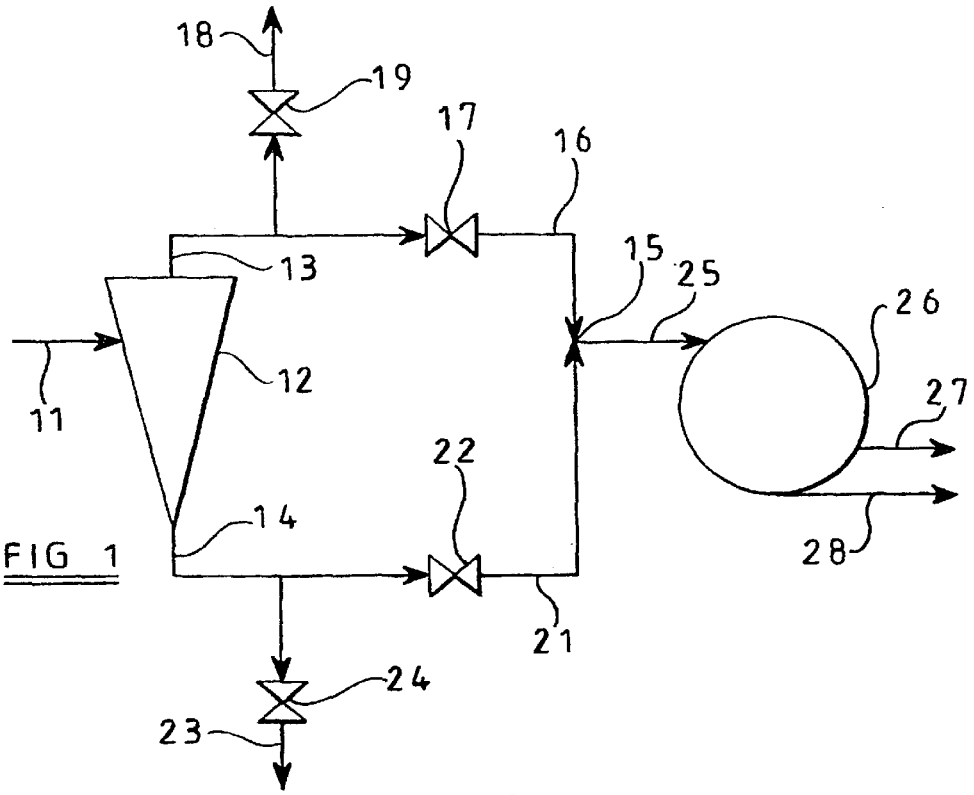

Referring first to FIG. 1 of the drawings, the well stream 11 of an oil well or other hydrocarbon well (or a proportion thereof) containing a gas/liquid mixture, usually, gas, oil, and water is supplied to the inlet of a gas/liquid cyclone separator 12 which separates the well stream 11 into its gaseous and liquid phases without any significant pressure loss. The gaseous phase of the well stream issues from the cyclone separator by way of its reject outlet 13 while the liquid phase issues from the underflow outlet 14 of the separator 12.

The reject outlet 13 is connected to a mixing device 15 through a line 16 containing a control valve 17. In addition, the reject outlet 13 is connected to a gas discharge line 18 through a control valve 19. A line 21 connects the underflow outlet 14 with the mixer 15, the line 21 including a control valve,22 and in addition the underflow outlet 14 is connected to a liquid discharge line 23 through a control valve 24. The mixer 15 has an outlet line 25 coupled to the inlet nozzle of a rotary separation turbine 26 which has gas and liquid outlet ports 27, 28 connected respectively to the gas and liquid output lines 18, 23.

Taking a simplistic, overview of the process and apparatus of FIG. 1, the control valves 17, 19 and 22, 24 are set by an operator to achieve the supply to the mixer 15, at predetermined flow rates and pressure, of a predetermined ratio of the gaseous and liquid phases issuing from the separator 12.

The rotary separation turbine 26, and in particular its inlet nozzle, will have been designed to operate most efficiently when supplied, at a predetermined flow rate and pressure, with a mixture containing a predetermined gas/liquid ratio. The valves 17, 19, 22, 24 are thus adjusted to ensure that appropriate proportions of the gaseous and liquid phases issuing from the separator 12 are routed to the mixer 15 where they are recombined for supply to the inlet nozzle of the rotary separation turbine 26.

Within the rotary separation turbine, the recombined gaseous phase flashes out of the gas/liquid mixture as the mixture passes through the inlet nozzle of the turbine thus accelerating the liquid phase onto the rotary component of the turbine and driving the rotary component. Rotational energy of the rotating component of the turbine (and thus of the well stream) can be recovered in a number of ways, for example by coupling an electrical generator to the shaft of the rotary component, or by using scoops dipping into a liquid layer on the rotating component to derive a pressurised liquid supply from the rotary separator. The manner in which the energy is "tapped" from the rotary separation turbine is not of importance to the present invention, and will be determined, to a large extent, by the nature of the turbine which has been selected.

It will be recognised that in addition to recovering energy from the well stream the rotary separation turbine separates the recombined portion of the well stream into at least its gaseous and liquid components for furth, processing. Where the liquid component contains oil and water then the rotary separation turbine 26 can be designed to effect separation of the liquid phase into its different density components.

Figure 2:
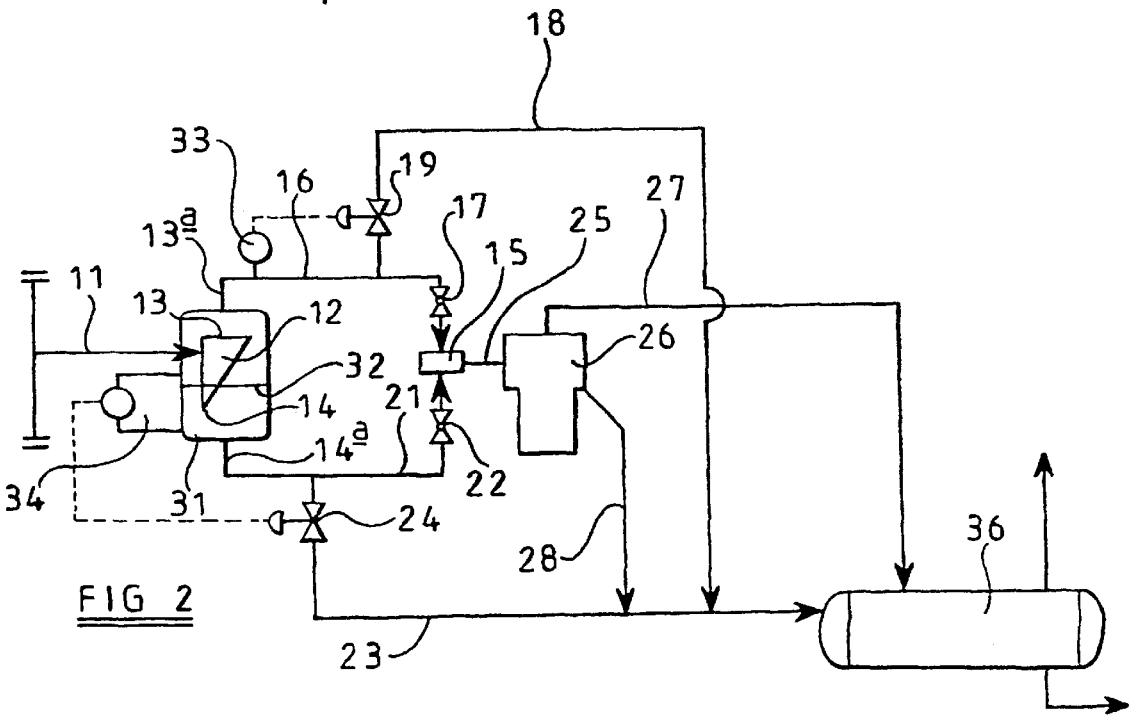
FIG. 2 is a diagrammatic representation of an enhancement of the process and apparatus illustrated in FIG. 1.

The arrangement described with reference to FIG. 1 cannot respond to changes in the composition of the well stream. The apparatus illustrated in FIG. 2 is an enhancement of the arrangement illustrated in FIG. 1, and depicts a practical application of the principles disclosed in FIG. 1 in which changes in well stream composition can be accommodated automatically.

It can be seen that the cyclone separator 12 is housed within a pressure vessel 31, the inlet for the separator 12 being ducted through the wall of the vessel 31. The separator 12 discharges the gaseous and liquid components separated from the well stream 11 into the vessel 31, such that the upper part of the vessel 31 is filled with gas while the lower part is filled with liquid, the liquid level being illustrated in FIG. 2 at 32. The upper wall of the vessel 31 has a gas outlet 13*a* connected through the line 16 to one inlet of the mixer 15, the valve 17 being disposed in the line 16 as described above.

The lower wall of the vessel 31 has a liquid outlet 14*a* connected through the line 21 and the valve 22 to the mixer 15. As described above the outlet 13*a* is connected to the gas discharge line 18 through valve 19 and the outlet 14*a* is connected through valve 24 to the liquid output line 23. However, the valves 19 and 24 are arranged to be capable of automatic operation. The valve 19 is controlled automatically by a pressure sensor arrangement 33 monitoring the pressure in the gas line 16 adjacent the outlet 13*a*. The valve 24 is controlled by a liquid level sensor arrangement 34 which monitors the liquid level 32 within the vessel 31 and supplies a control signal to the valve 24. It will be understood that the exact manner in which signals derived in relation to gas pressure and liquid level are utilised to operate the valves 19 and 24 is not of importance to the invention.

The setting of the valves 17, 22 determines the proportions of gas and liquid supplied to the mixer 15 and thus the gas/liquid ratio of the mixture supplied at controlled pressure and flow to the inlet nozzle of the turbine 26. The valves 19, 24 are controlled to bypass excess gas and liquid respectively from the lines 16, 21 so as to maintain predetermined pressure and flow characteristics in the lines 16, 21 dictated by the settings of the valves 17, 22. Provided that the pressure and makeup of the well stream 11 remain within a predetermined range then the control regime compensates automatically for variations in the parameters of the well stream 11 to maintain the supply to the line 25 optimised in relation to the chosen rotary turbine separator 26.

In many applications the valves 17, 22 will be manually operable devices adjusted during a set-up phase to give the desired gas/liquid ratio at the mixer 15. However, it is to be understood that if desired automated control of the valves 17, 22 is possible.

FIG. 2 illustrates that the well stream 11 may be derived from a plurality of wells rather than just a single well, the individual well streams being fed into a single manifold or supply line where they mix prior to being passed to the inlet of the cyclone separator 12. Clearly adding or removing one or more streams to or from the combined well stream can generate significant variations in the well stream parameters, which ordinarily would render the mixture fed to the turbine some way from optimum. The system described above with reference to FIG. 2 can accommodate such variations, maintaining the optimum mixture supply to the turbine 26.

FIG. 2 illustrates a gravity separator 36 of conventional form, downstream of the turbine 26. The gravity separation vessel has a liquid inlet receiving liquid from the discharge line 23, and the outlet 28 of the turbine. In addition the gravity separation vessel has a gas inlet receiving the separated gas from the outlet 27 of the turbine. The gas discharge line 18 from the cyclone separator 12 is shown, for convenience, communicating with the liquid discharge line 23 adjacent the vessel 36. It is to be understood however that if desired the gas discharge line 18 could communicate with the gas discharge from the turbine 26, provided that the pressures are appropriately matched. The turbine 26 recovers energy from the well stream as described above, and the gravity separator 36 completes the separation of the well stream into gaseous and liquid phases. Moreover, where the liquid phase is a mixture of oil and water the gravity separator can, if desired, be arranged to permit gravity separation of the oil and water, although as drawn in FIG. 2 the separator 36 has only a gas outlet and a liquid outlet. Where three phase separation occurs in the separator 36 there will be gas, oil and water outlets. It is to be recognised however that it is not essential that the final stage of separation is a gravity separator, and other known separation techniques can be used at this point, including the use of further cyclone separators and/or further turbine separators.

Figure 3:
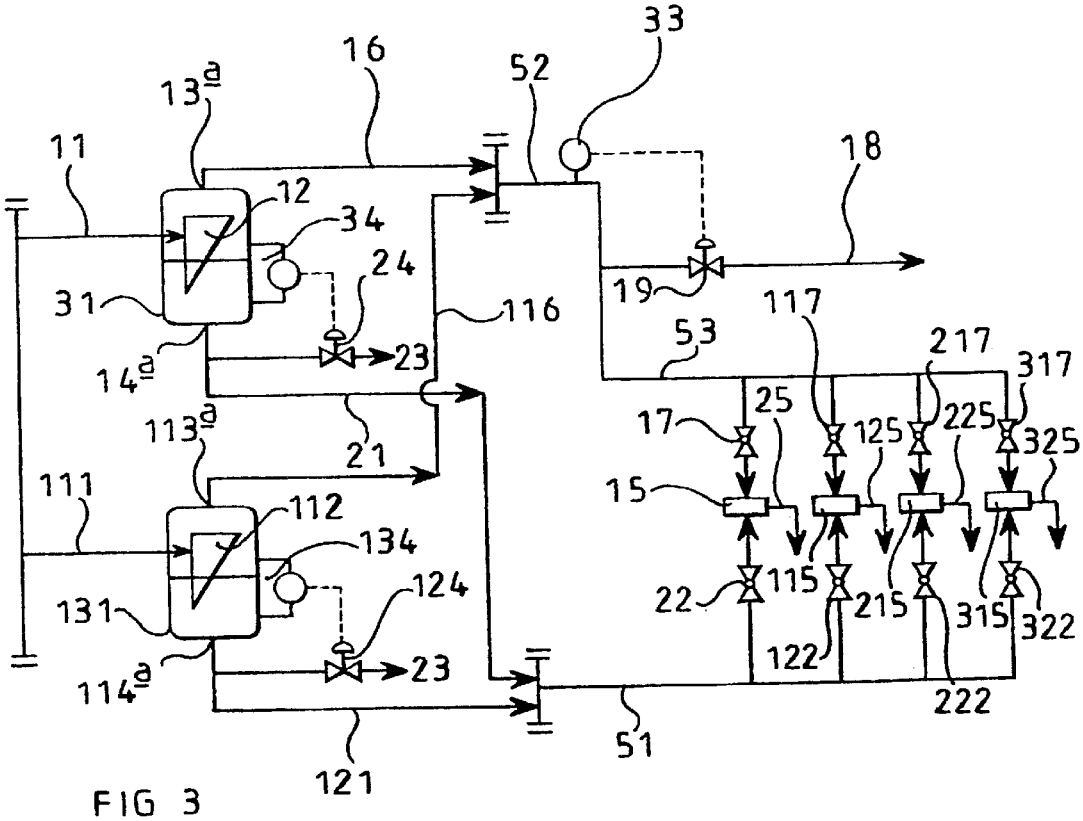
FIG. 3 is a diagrammatic representation of a modification of the arrangement illustrated in FIG. 2 in which more than one rotary separation turbine may be supplied from more than one well stream, and, FIG. 4 is a diagrammatic representation of a further modification.

FIG. 3 illustrates a process and apparatus similar to that described above with reference to FIG. 2, but utilising a plurality of cyclone separators performing the pre-separation of the well stream or well streams. It will of course be understood that in a variant of FIG. 2 a plurality of cyclone separators each having its own pressure vessel and each having its own associated pressure and liquid level sensors could be utilised. However, FIG. 3 illustrates a refinement of such a multiple cyclone arrangement in which each cyclone has its own respective liquid level control system, but all of the cyclones share a common gas pressure control system. Thus referring specifically to FIG. 3 it can be seen that the first and second gas/liquid cyclone separators 12, 112 receive respective well streams 11, 111, although in practice the well streams 11, 111 may be parts of a common well stream derived from one or more wells, or may be separate well streams from respective wells. Each cyclone separator 12, 112 is housed within a respective pressure vessel 31, 131 having respective gas and liquid outlets 13*a*, 14*a* and 113*a*, 114*a* as described above. A respective liquid level monitoring arrangement 34, 134 monitors the liquid level within the respective pressure vessel and controls a respective valve 24, 124 determining how much of the liquid phase separated by the respective cyclone separator bypasses the mixing arrangement and flows to a common liquid discharge line 23. The predetermined remainder of the liquid output from each of the cyclone separators flows through a respective line 21, 121 into a common liquid manifold 51.

The gas outlets 13*a*, 113*a* of the vessels 31, 131 are connected through respective lines 16, 116 to a common gas line 52 supplying a gas manifold 53. A gas pressure monitoring arrangement 33 monitors the gas pressure in the line 52 and supplies a control signal to a valve 19 to control the amount of gas which bypasses the mixing arrangement and flows to a common gas discharge line 18. It will be recognised that as described with reference to FIG. 2 the valves 17, 22 (117, 122; 217, 222; 317, 322) adjacent each mixer set the gas/liquid ratio for their respective mixer. The valve 19 is controlled to bypass gas which is excess to the "demand" of the mixers to the output line 18, and thus the control of the valve 19 ensures that the pressure stays within its operating limits and provides stable flow characteristics of lines 51 and 53. Similarly the control of valves 24 and 124 ensures that excess liquid bypasses the mixers to the output line 23.

The arrangement illustrated in FIG. 3 is intended to supply four separate, substantially identical rotary separation turbines (not shown). Thus in relation to each of the turbines there is provided a respective mixer 15, 115, 215, 315 supplied with gas and liquid from the manifolds 53, 51 through respective valves equivalent to the valves 17, 22 of FIG. 2. Each mixer has a respective output line connected to the nozzle of its respective turbine. It will be recognised that the settings of the valves in the lines connecting each manifold 51, 53 to the respective mixer control determine the gas/liquid ratio of the mixture supplied to the respective turbine inlet nozzle, and each valve can be finely adjusted to accommodate minor differences in specification between the otherwise identical rotary separation turbines. Furthermore, while FIG. 3 illustrates only first and second cyclone separators, it will be understood that exactly the same principle can be applied with a greater number of cyclone separators. Similarly, although FIG. 3 illustrates the supply to four rotary separation turbines it is to be understood that more, or fewer, turbines can be accommodated if desired.

Figure 4:
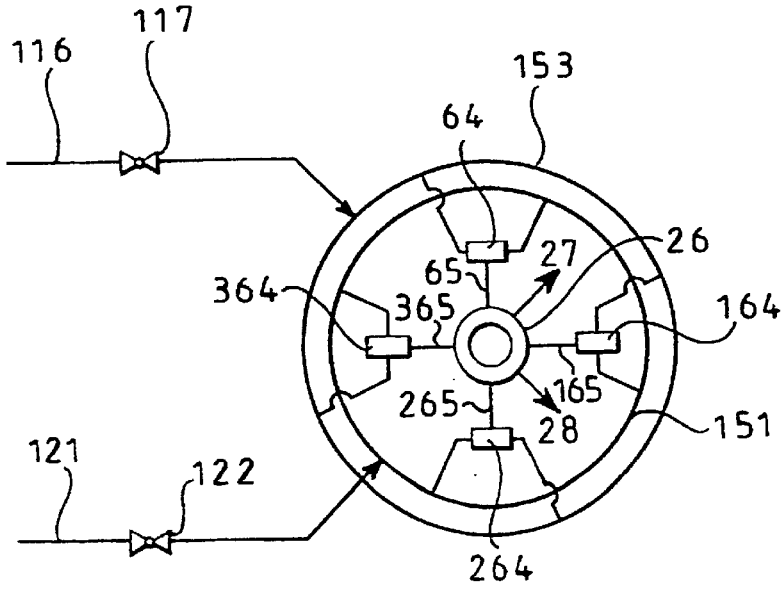

FIG. 4 illustrates a modification which may be used with any of the arrangements illustrated in FIGS. 1 to 3 where the rotary separation turbine 26 has a plurality of separate inlet nozzles. FIG. 4 discloses an arrangement in which the rotary separation turbine has four angularly spaced inlet nozzles, together with a gas outlet 27 and a liquid outlet 28.

The appropriate proportions of gas and liquid, conveniently derived in the manner described with reference to any one of FIGS. 1, 2 and. 3 above is supplied through lines 116 and 121 respectively to gas and liquid manifolds 153, 151 of the rotary separation turbine. Line 116 includes a control valve 117 for setting the gas proportion of the supply to the manifolds while line 121 includes a similar valve 122 for setting the liquid proportion of the supply to the manifolds. The manifolds 151 and 153 encircle the fixed housing of the rotary separation turbine, and each is connected to a respective gas/liquid mixer 64, 164, 264, 364 which supplies a respective turbine inlet nozzle through a respective line 65, 165, 265, 365. Thus each mixer recombines the appropriate proportions of gas and liquid for supply to the inlet nozzles of the rotary separation turbine at a point immediately adjacent the nozzle.

The arrangement shown in FIG. 4 overcomes the difficulty of dividing a mixed flow into four separate parts to supply the four nozzles respectively. Mixed (multiphase) flows are difficult to divide accurately, and the FIG. 4 arrangement obviates the problem by dividing the liquid phase into four parts, one for each nozzle; dividing the gas phase into four parts, again one for each nozzle; and then recombining the gas and liquid parts individually in a mixer specific to, and closely adjacent a respective nozzle.

While the use of one or more gas/liquid cyclone separators as the pre-separation stage of the above described apparatus and processes is preferred, it is to be recognised that other separator devices with associated sensors could be utilised as the pre-separation stage.

What is claimed is:

1. A process for the recovery of energy from a pressurized well stream from a hydrocyclone well, the stream containing a gas/liquid mixture, the process comprising treating the well stream to a pre-separation process to separate it into gaseous and liquid phases, selecting appropriate proportions of said separated gaseous and liquid phases, recombining said selected proportions, and supplying the recombined mixture to the inlet of a rotary separation turbine wherein said components are separated and energy is recovered from the flow by rotation of the turbine, said proportions of said gaseous and liquid phases being selected to produce an optimum mixture for supply to the rotary separation turbine.

2. A process as claimed in claim 1, wherein the pre-separation process is performed in a cyclone separator.

3. A process as claimed in claim 1, wherein the pre-separation and selection process is responsive to changes in the composition of the well stream.

4. A process as claimed in claim 1, wherein the well stream is a combined stream derived from a plurality of hydrocarbon wells by mixing the individual streams from the wells.

5. A process as claimed in claim 1, wherein the liquid component of the well stream is a mixture of liquids of different densities and the rotary separation turbine is arranged to separate the liquid component into at least two constituent parts.

6. A process as claimed in claim 1, wherein there is a plurality of cyclone separators in the pre-separation process.

7. A process as claimed in claim 1, wherein recombined mixture is supplied to a plurality of rotary separation turbines.

8. An apparatus for recovering energy from a well stream comprising a pre-separation device for separation of the well stream into gaseous and liquid components, selection means for selecting predetermined proportions of said gaseous and liquid components, mixing means for recombining said selected proportions, and a rotary separation turbine driven by said recombined mixture.

9. Apparatus as claimed in claim 8, wherein the pre-separation device is a cyclone separator.

10. Apparatus as claimed in claim 8, wherein the pre-separation device includes a plurality of cyclone separators.

11. Apparatus as claimed in claim 8, wherein the selection means is controlled by monitoring means monitoring the composition of the well stream whereby said selection means is responsive to variation in the composition of the well stream in use.

12. Apparatus as claimed in claim 11, wherein the pre-separation device is housed within a pressure vessel which receives the well stream components separated by the pre-separation device, and valves for discharging gas and liquid from the vessel in accordance with the liquid level and gas pressure within the vessel so that gaseous and liquid components of the well stream, in appropriate proportions, can be recombined for supply to the rotary separation turbine.

13. Apparatus as claimed in claim 8, including manifold means upstream of the pre-separation device for mixing individual streams from a plurality of wells to produce the well stream supplied to the pre-separation device.

14. Apparatus as claimed in claim 8, wherein the rotary separation turbine discharges the separated gas and liquid components of the well stream into a gravity separator in which further separation of gaseous and liquid components takes place.

15. Apparatus as claimed in claim 8, wherein the recombined gaseous and liquid components from the selection means is supplied to a plurality of rotary separation turbines.

16. Apparatus as claimed in claim 8, wherein the pre-separation device includes a plurality of cyclone separators, each cyclone separator being housed within its own pressure vessel, each pressure vessel having its own liquid level control system, but there being a common gas pressure control system serving all of the vessels, the gas pressure control system and the individual liquid level control systems each producing control signals controlling the proportions of gas and liquid supplied from each vessel for recombination and onward supply to the rotary separation turbine or turbines.

17. Apparatus as claimed in claim 8, in which the means for mixing, for recombining said selected proportions of said gaseous and liquid components is positioned in close proximity to the inlet nozzle of the rotary separation turbine.

18. Apparatus as claimed in claim 17, wherein the rotary separation turbine has a plurality of inlet nozzles, each inlet nozzle has a mixing means positioned closely adjacent thereto, and each mixing means is supplied with gaseous and liquid components of the well stream, for recombination, by way of respective gas and liquid component manifolds.

19. Apparatus as claimed in claim 18, in which each manifold encircle the fixed housing of the rotary separation turbine.

* * * * *